US006248141B1

(12) United States Patent
Davies et al.

(10) Patent No.: US 6,248,141 B1
(45) **Date of Patent: *Jun. 19, 2001**

(54) OIL ADDITIVES AND COMPOSITIONS

(75) Inventors: Brian William Davies, Blewbury; Tuncel Ibrahim, Abingdon; Dhanesh Gordon Goberdhan, King Street, all of (GB)

(73) Assignee: Exxon Chemical Patents Inc., Linden, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/882,017

(22) Filed: Jun. 12, 1997

Related U.S. Application Data

(63) Continuation of application No. 08/360,670, filed as application No. PCT/EP93/01668 on Jun. 29, 1993, now abandoned.

(30) Foreign Application Priority Data

Jun. 30, 1992 (GB) ..... 9213870

(51) Int. Cl.[7] ..... C10L 1/18
(52) U.S. Cl. ..... 44/393
(58) Field of Search ..... 44/393

(56) References Cited

U.S. PATENT DOCUMENTS

| | | | | |
|---|---|---|---|---|
| 3,762,888 | * | 10/1973 | Kober et al. | 44/393 |
| 3,961,916 | * | 6/1976 | Ilnyckyj et al. | 44/395 |
| 4,019,878 | * | 4/1977 | Wisotsky | 44/393 |
| 4,375,973 | * | 3/1983 | Rossi et al. | 44/459 |
| 5,045,088 | * | 9/1991 | More et al. | 44/393 |

FOREIGN PATENT DOCUMENTS

| | | | | |
|---|---|---|---|---|
| 045342A1 | | 2/1982 | (EP) . | |
| 0225688 | * | 6/1987 | (EP) . | |
| 58-129096 | | 8/1983 | (JP) | C10L/1/18 |
| 9115562 | * | 10/1991 | (WO) . | |

* cited by examiner

*Primary Examiner*—Margaret Medley
*Assistant Examiner*—Cephia D. Toomer

(57) ABSTRACT

Compositions comprising copolymers of ethylene and an ester of an unsaturated alcohol and a carboxylic acid having at least 3 carbon atoms improve the low temperature properties of fuel oils.

22 Claims, No Drawings

OIL ADDITIVES AND COMPOSITIONS

This is a continuation, of application Ser. No. 08/360,670 filed Dec. 21, 1994, now abandoned which is a 371 of PCT/EP93/01668 filed Jun. 29, 1993.

This invention relates to oil compositions, primarily to fuel oil compositions, for example fuel oil compositions especially susceptible to wax formation at low temperatures, and to the use of additive compositions in such oil compositions to improve their low temperature properties.

Heating oils and other distillate petroleum fuels, for example, diesel fuels, contain alkanes that at low temperature tend to precipitate as large crystals of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter; certain additives inhibit the wax from crystallizing as platelets and cause it to adopt an acicular habit, the resulting needles being more likely to pass through a filter than are platelets. The additives may also have the effect of retaining in suspension in the fuel the crystals that have formed, the resulting reduced settling also assisting in prevention of blockages.

Effective wax crystal modification (as measured by CFPP (cold filter plug point) and other operability tests, as well as simulated and field performance) may be achieved by ethylene-vinyl acetate or propionate copolymer (EVAC or EVPC)-based flow improvers. CFPP, as used in this specification, is measured as described in "Journal of the Institute of Petroleum", 52 (1966), 173.

In EP-A-45342 is described a cold flow additive, based on an EVAC modified by esterification with 2-ethylhexanoic, acrylic, and phthalic acids.

In "Wissenschaft und Technik" 42(6), 238 (1989), M. Ratsch & M. Gebauer describe cold flow additives including an EVAC esterified with, inter alia, n-hexanoic acid.

In U.S. Pat. No. 3,961,916, middle distillate flow improvers are described which comprise a wax growth arrestor and a nucleating agent, the former being preferably a lower molecular weight ethylene-vinyl ester copolymer with a higher ester content, the latter preferably a higher molecular weight copolymer with a lower ester content, the esters preferably, but not necessarily, both being vinyl acetate.

In DE-AS-2407158, middle distillate flow improvers are described, comprising a mixture of low molecular weight ethylene-vinyl ester and ethylene-acrylic acid ester copolymers, both containing at least 40 mole percent of the ester component.

It has, however, proved difficult to treat certain oils to reduce their CFPP. Particularly difficult are those with higher wax contents, i.e., in excess of 2.5% (measured at 10° C. below cloud point) and more especially above 2.9%, in particular, those with 3.0% wax or more. Especially difficult are those fuels obtained from high wax content crudes with a relatively low final boiling point, e.g., at most 370° C. and more especially at most 360° C.

The present invention is concerned to provide an oil, especially a fuel oil, additive effective to improve low temperature flow of a higher wax content oil, and is based on the observation that certain copolymers of ethylene with an unsaturated ester are effective cold flow improvers having advantages over previously proposed compositions for such oils.

In a first aspect, the present invention provides the use of an oil soluble ethylene copolymer having in addition to units derived from ethylene units of the formula $$—CH_2CROOCR^1— \text{ or } —CH_2CRCOOR^1— \qquad \text{I,}$$

wherein R represents H or $CH_3$ and $R^1$ represents a hydrocarbyl group having at least 2 carbon atoms, to improve the low temperature properties of an oil having a wax content of at least 2.5% by weight, measured at 10° C. below cloud point by differential scanning calorimetry.

In a second aspect, the invention provides a composition comprising an oil having a wax content of at least 2.5%, measured at 10° C. below cloud point by differential scanning calorimetry, and a minor proportion of an ethylene copolymer having in addition to units derived from ethylene units of the formula I as defined above.

The invention is especially applicable to oils having, by weight, a wax content of at least 2.9%, and more especially to those having a wax content of at least 3.0%. More especially, the invention is useful in oils having a final boiling point of up to 370° C., particularly oils with a final boiling point up to 360° C.

Advantageously, the molar proportion of units I in the ethylene copolymer is up to 35%. In one embodiment of the invention, the molar proportion is more especially from 1 to 25%, preferably from 10 to 20%, and most preferably from 11 to 16%. In this embodiment, advantageously, the number average molecular weight of the copolymer, measured by gel permeation chromatography, is at most 14000, more advantageously in the range of 1400 to 7000, preferably from 2000 to 5500, and most preferably about 4000.

In a second embodiment, the polymer according to the invention may contain up to 10, preferably from 1 to 7.5, molar per cent of ester units and have a number average molecular weight of at most 20,000, preferably from 3,000 to 10,000.

Advantageously, the linearity of the polymer as expressed by the number of methyl groups per 100 methylene units, as measured by proton NMR, is from 1 to 15.

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g., alkyl or alkenyl), alicyclic (e.g., cycloalkyl or cycloalkenyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulfur, and, preferably, oxygen. Advantageously, the hydrocarbyl group contains at most 30, preferably at most 15, more preferably at most 10 and most preferably at most 8, carbon atoms. Advantageously, the hydrocarbyl group contains at least 3 carbon atoms.

Advantageously R represents H. Advantageously $R^1$ represents an alkenyl or as indicated above, preferably, an alkyl group, which is advantageously linear. If the alkyl or alkenyl group is branched, for example, as in the 2-ethylhexyl group, the α-carbon atom is advantageously part of a methylene group. Advantageously, the alkyl or alkenyl group contains up to 29 carbon atoms, preferably from 2 to 14 carbon atoms, and more preferably from 3 to 9, especially 3 to 7, carbon atoms. As examples of alkyl or alkenyl groups there may be mentioned propyl, n-butyl, iso-butyl, and isomers, preferably the linear isomers, of pentyl, hexyl, heptyl, octyl, nonyl, decyl, undecyl, dodecyl, tridecyl, tetradecyl, pentadecyl, hexadecyl, heptadecyl, octadecyl, nonadecyl and icosyl, and their corresponding alkenyl, advantageously alk-omega-enyl, radicals. $R^1$ most preferably represents pentyl or heptyl and, as indicated above, is advantageously the linear isomer.

As cycloalkyl, alkaryl and aryl radicals, there may be mentioned, for example, cyclohexyl, benzyl and phenyl.

The unit of the formula I is advantageously a unit of the formula $—CH_2CROOCR^1—$.

The copolymer or copolymers may also contain units of formulae other than those mentioned above, for example units of the formula $$—CH_2—CRR^2— \qquad \text{II}$$

where $R^2$ represents —OH, or of the formula $$—CCH_3(CH_2R^3)—CHR^4— \qquad \text{III}$$

where $R^3$ and $R^4$ each independently represent hydrogen or an alkyl group with up to 4 carbon atoms, the units III advantageously being derived from isobutylene, 2-methylbut-2-ene or 2-methylpent-2-ene.

Units of the formula I may be terminal units but are advantageously internal units.

It is within the scope of the invention to use a polymer having different units of type I, or mixtures of two or more polymers.

The oil may be a lubricating oil, which may be an animal, vegetable or mineral oil, such, for example, as petroleum oil fractions ranging from naphthas or spindle oil to SAE 30, 40 or 50 lubricating oil grades, castor oil, fish oils or oxidized mineral oil. Such an oil may contain additives depending on its intended use; examples are viscosity index improvers such as ethylene-propylene copolymers, succinic acid based dispersants, metal containing dispersant additives and zinc dialkyl-dithiophosphate antiwear additives. The compositions of this invention may be suitable for use in lubricating oils as flow improvers, pour point depressants or dewaxing aids.

The oil may be a crude oil or a fuel oil, especially a middle distillate fuel oil. The fuel oil may comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oils or of both. The above-mentioned low temperature flow problem is most usually encountered with diesel fuels and with heating oils. The invention is also applicable to vegetable-based fuel oils, for example rape seed oil.

The additive or additives should preferably be soluble in the oil to the extent of at least 1000 ppm by weight per weight of oil at ambient temperature. However, at least some of the additive may come out of solution near the cloud point of the oil and function to modify the wax crystals that form.

The ethylene copolymer may be made by any of the methods known in the art, e.g., by solution polymerization with free radical initiation, or by high pressure polymerization, conveniently carried out in an autoclave or a tubular reactor.

Alternatively and preferably, the copolymer may be made by saponification and re-esterification of an ethylene-vinyl ester copolymer.

A further method of making the copolymer is by transesterification, provided that the entering acid or alcohol is less volatile than that being removed.

If desired all, or substantially all, existing ester groups may be hydrolysed and completely replaced by the desired chain substituents. Alternatively, a proportion only may be hydrolysed, so that the resulting polymer contains acetate side chains and chains of longer length.

The additive composition and the oil composition may contain other additives for improving low temperature and/or other properties, many of which are in use in the art or known from the literature.

For example, the composition may also contain a further ethylene-vinyl ester copolymer. As mentioned above, with reference to U.S. Pat. No. 3,961,916, flow improver compositions may comprise a wax growth arrestor and a nucleating agent. Without wishing to be bound by any theory, the applicants believe that if the additive copolymers of the present invention have more than about 7.5 molar per cent of ester units they act primarily as arrestors, and benefit from the addition of nucleators, e.g., an ethylene-vinyl ester, especially acetate, having a number average molecular weight in the range of 1200 to 20000, and a vinyl ester content of 0.3 to 12 molar per cent, advantageously an ester content lower, and preferably at least 2, more preferably at least 3, molar per cent lower, than that of any ester in the ethylene copolymer as defined above.

If, however, the copolymer of the invention contains less than about 10 molar per cent of ester units then correspondingly it acts primarily as a nucleator and benefits from the presence of an arrestor which may be an ethylene/unsaturated ester copolymer with correspondingly lower molecular weight and higher ester content.

It is of course in accordance with the invention to use an arrestor and a nucleator that are both copolymers with units I as defined above.

The additive composition may also comprise a comb polymer. Such polymers are discussed in "Comb-Like Polymers. Structure and Properties", N. A. Platé and V. P. Shibaev, J. Poly. Sci. Macromolecular Revs., 8, p 117 to 253 (1974).

Advantageously, the comb polymer is a homopolymer having, or a copolymer at least 25 and preferably at least 40, more preferably at least 50, molar percent of the units of which have, side chains containing at least 6, and preferably at least 10, atoms.

As examples of preferred comb polymers there may be mentioned those of the general formula

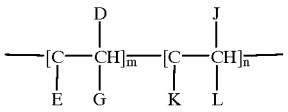

wherein

D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl, and m and n represent mole ratios, m being within the range of from 1.0 to 0.4, n being in the range of from 0 to 0.6. $R^{11}$ advantageously represents a hydrocarbyl group with from 10 to 30 carbon atoms, while $R^{12}$ advantageously represents a hydrocarbyl group with from 1 to 30 carbon atoms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g., an α-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan- 1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in European Patent Applications 153176, 153177 and 225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous.

The additive composition may also comprise polar nitrogen compounds, for example those described in U.S. Pat. No. 4,211,534, especially an amide-amine salt of phthalic anhydride with two molar proportions of hydrogenated tallow amine, or the corresponding amide-amine salt of ortho-sulphobenzoic anhydride.

The additive composition of the invention may also comprise a copolymer of ethylene and at least one α-olefin, having a number average molecular weight of at least 30,000. Preferably the α-olefin has at most 20 carbon atoms. Examples of such olefins are propylene, 1-butene, isobutene, n-octene-1, isooctene-1, n-decene-1, and n-dodecene-1. The copolymer may also comprise small amounts, e.g, up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is, as indicated above, at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 percent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

The additive composition may also comprise a further ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent although for ethylene-propylene copolymers up to 86 molar per cent by weight ethylene may be employed with advantage.

The composition may also comprise poly(ethylene glycol) esters, advantageously of fatty acids containing from 18 to 22 carbon atoms in the chain.

In addition, the fuel oil composition may contain additives for other purposes, e.g., for reducing particulate emission or inhibiting colour and sediment formation during storage.

The fuel oil composition of the invention advantageously contains the copolymer of the invention in a total proportion of 0.0005% to 1%, advantageously 0.001 to 0.1%, and preferably 0.04 to 0.06% by weight, based on the weight of fuel.

The following Examples, in which all parts and percentages are by weight, and number average molecular weights are measured by gel permeation chromatography, illustrate the invention.

EXAMPLE A

10 Kg (3.33 mole) of an ethylene-vinyl acetate copolymer containing 35% by weight vinyl acetate, Mn 3,000, degree of branching $4CH_3/100\ CH_2$, is charged into a flask equipped with a condenser and heated to 60° C. with stirring under a nitrogen blanket. 216 g (1 mole) of sodium methoxide in 1.5 l n-butanol is added cautiously to the polymer, and subsequently a further 4 l of n-butanol. The solution changes from clear to orange, and the temperature falls to 46° C. The mixture is then heated to 90° C., the colour turning to deep red, and maintained at that temperature with stirring for 2 hours.

The reaction mixture is then heated at 104° C., at a pressure of 370 mm Hg, to distil off approximately 4 l butyl acetate. The remaining viscous polymer is poured at 90° C. into an acidified (150 ml 36 wt % solution of HCl) solvent comprising 100 l water and 5 l acetone. The solution is stirred for 3 hours, and the solids allowed to settle overnight at pH 6. After draining, the polymer is filtered through a fine mesh cloth and dried at 70° C.

20 g of the resulting polymer (Mn 3300, 85% hydrolysed as determined by NMR) are dissolved in an anhydrous mixture of 100 ml toluene and 10 ml pyridine. 30 ml lauroyl chloride dissolved in 100 ml toluene is added dropwise and the reaction mixture stirred for 1 hour at room temperature. The resulting solids are filtered off and solvent removed under vacuum to yield a viscous polymer. Further drying at 120° C. in vacuo to remove volatiles gives 21 g of a polymer in which $R^1$ represents n-undecyl. Yield 21 g, Mn 5000.

EXAMPLE B

The second part of Example A was repeated, but esterifying 50 g of the saponified polymer with myristoyl chloride to give a polymer in which $R^1$ represents n-tridecyl. Yield 40 g, Mn 5000.

EXAMPLE C

The second part of Example A was repeated, but esterification was with hexanoyl chloride, yielding a polymer Mn 3700, in which in $R^1$ represents n-pentyl.

EXAMPLE D

The procedure of the first part of Example A was repeated, saponifying 450 g of an ethylene-vinyl acetate copolymer, 13.5% by weight vinyl acetate, Mn 5,000, degree of branching 6 $CH_3/100\ CH_2$, using 47.5 g sodium methoxide and a total 250 g n-butanol.

50 g of the resulting polymer (Mn 4000, 93% hydrolysis) are dissolved in an anhydrous solvent mixture comprising 375 ml toluene and 8 ml pyridine. 14 ml hexanoyl chloride in 250 ml toluene are added dropwise and the resulting mixture stirred for 5 hours at room temperature. The solids are filtered and solvent removed in vacuo to yield a viscous polymer which is further dried in vacuo at 120° C. to yield 38 g of a polymer (Mn 4000) in which $R^1$ represents n-pentyl.

EXAMPLE E

The procedure of the first part of Example A was repeated, saponifying 100 g of an ethylene-vinyl acetate copolymer containing 29% by weight vinyl acetate, Mn 3,300, degree of branching $CH_3/100\ CH_2$: 4, using 19.3 g sodium methoxide and 90 g n-butanol.

Yield: 74 g;

Mn 3000, 93% hydrolysis.

20 g of the resulting saponified polymer are dissolved in an anhydrous solvent comprising 150 ml toluene and 6 ml pyridine at room temperature. 10 ml hexanoyl chloride in 100 ml toluene are added dropwise and the reaction mixture stirred for 5 hours at room temperature. The product is dried as described in Example C, yielding 20 g of a similar polymer.

EXAMPLE F

The procedure of Example C was repeated, but the saponified product was re-esterified with n-heptanoyl chloride.

EXAMPLE G

The procedure of Example C was repeated, but the saponified product was re-esterified with n-octanoyl chloride.

EXAMPLE H

Into a 3 liter stirred autoclave were charged 636 g of cyclohexane, 148.5 g of vinyl butyrate, and sufficient ethylene to achieve a pressure of 97 bar (9.7 MPa) at 124° C. 18 g of t-butyl peroctoate were dissolved in 85 ml cyclohexane and metered in with a further 351 g of vinyl butyrate and ethylene to maintain the above pressure over 75 minutes. After a soak time of 10 minutes, the reactor vessel was flushed with xylene. After evaporation of solvent, 992 g of ethylene-vinyl butyrate copolymer were recovered, vinyl butyrate content 36%, Mn 2400.

EXAMPLE J

A mixture containing vinyl acetate, isobutylene and ethylene, with 500 ppm t-butyl peroctoate, was polymerized in an autoclave at 1200 bar, 220° C.

An ethylene/vinyl acetate/isobutylene terpolymer, with 13.5% vinyl acetate and.7.8% isobutylene by weight, 9.3 $CH_3$ units per hundred $CH_2$ by NMR, Mn 5450 was recovered.

EXAMPLE K 100 g of ethylene-vinyl acetate copolymer, 36% by weight vinyl acetate, Mn 3300, degree of branching $CH_3$:100 $CH_2$:4, were put into a flask fitted with a stirrer, thermocouple (connected to heat controller), nitrogen inlet and a condenser arranged for distillation, and heated to 60° C. 66.46 g (molar equivalent) of methyl octanoate and 2.268 sodium methoxide (0.1 molar equivalent, as catalyst) were added, and the mixture was heated to 80° C. After 15 minutes, the reaction mixture was heated to 120° C., and maintained at that temperature, a clear distillate collecting in the condenser flask. Samples of polymer were taken at intervals to follow the progress of transesterification by comparing the height of the IR peak at 1240 $cm^{-1}$ (acetate group) with that at 1170 $cm^{-1}$ (octanoate). After 3½ hours, 79% of acetate groups had been replaced, and 11 g of distillate recovered. The reaction was continued at 120° C. for a further 5 hours, after which time 92% of acetate groups had transesterified. After a further 4 hours at 120° C. with total distillate at 18.2 g, the product was recovered. Yield 122 g, transesterification 94%. Number average molecular weight 4250.

The following fuels were used in Tests described in the following examples:

| Fuel | 1 | 2 | 3 | 4 | 5 | 6 | 7 | 8 | 9 | 10 | 11 | 12 | 13 |
|---|---|---|---|---|---|---|---|---|---|---|---|---|---|
| Cloud Point, ° C. | −5 | −6 | −5 | −3 | −6 | −7 | −12 | −3 | −4 | +8 | −2 | −6 | +1 |
| S.G. | 0.838 | 0.847 | 0.842 | 0.842 | 0.845 | 0.834 | 0.850 | 0.846 | 0.830 | 0.866 | 0.884 | 0.84 | |
| CFPP, ° C. | −6 | −8 | −6 | −3 | −7 | −8 | −12 | −4 | −7 | +3 | −4 | −10 | 0 |
| IBP, ° C. | 153 | 154 | 142 | 180 | 185 | 111 | 150 | 174 | 124 | 241 | 178 | 168 | 176 |
| FBP, ° C. | 354 | 361 | 360 | 364 | 364 | 357 | 360 | 369 | 357 | 372 | 368 | 358 | 368 |
| 90–20, ° C. | 105 | 80 | 102 | 82 | 78 | 126 | 74 | 110 | 118 | 67 | 80 | 79 | 91 |
| FBP-90, ° C. | 24 | 31 | 32 | 26 | 35 | 31 | 36 | 26 | 31 | 19 | 27 | 31 | 28 |
| Wax Content, % at 10° C. below cloud point | 2.4 | 3.4 | 3.1 | 3.1 | 2.9 | 2.3 | 2.3 | 2.0 | 3.1 | 3.0 | 3.5 | 3.2 | 3.3 |

EXAMPLE 1

The product of Example E (referred to below as "Product") was used in each of the first 10 fuel oils identified in the Table above, at a treat rate appropriate to each fuel. The CFPP of each fuel treated with the product was compared with that for a fuel treated with the ethylene-vinyl acetate copolymer (referred to below as EVA) used as starting material in that Example, used at the same treat rate.

| | Wax | Treat | CFPP, ° C. | |
|---|---|---|---|---|
| Fuel | Content, % | Rate, ppm | Product | EVA |
| 1 | 2.4 | 300 | −13 | −15 |
| 2 | 3.4 | 300 | −11 | −11 |
| 3 | 3.1 | 100 | −16 | −14 |
| 4 | 3.1 | 200 | −12 | −6 |
| 5 | 2.9 | 200 | −18 | −17 |
| 6 | 2.3 | 100 | −18 | −11 |
| 7 | 2.3 | 50 | −20 | −24 |
| 8 | 2.0 | 100 | −15 | −15 |
| 9 | 3.1 | 100 | −16 | −12 |
| 10 | 3.0 | 400 | −15 | −12 |

It will be seen that with low wax fuels (Nos. 1, 6, 7 and 8) a copolymer of the invention, in which $R^1$ represents n-pentyl, is not generally more effective than the corresponding ethylene-vinyl acetate copolymer, which is in commercial use as a cold flow improver. In most of the higher wax fuels, in contrast, the copolymer of the invention shows a substantial advantage over the commercial product, and in no case is it less effective.

EXAMPLE 2

The product of Example C (denoted Product below) was used in Fuels 11 and 12 at a treat rate of 250 ppm, and the CFPP of the fuel compared with that of the same fuel treated with 250 ppm of the ethylene-vinyl acetate copolymer used as starting material (denoted EVA below) in Example C.

| | Wax | CFPP, ° C. | |
|---|---|---|---|
| Fuel | Content, % | Product | EVA |
| 11 | 3.5 | −16 | −9 |
| 12 | 3.2 | −20 | −15 |

EXAMPLE 3

A product similar to that of Example C, but re-esterified with octanoic acid (denoted Product below) was tested in Fuel 2 at a treat rate of 300 ppm, and the CFPP of the treated fuel compared with the CFPP of the same fuel treated with the starting copolymer (denoted EVA below), used at the same treat rate.

| | | CFPP, ° C. | |
|---|---|---|---|
| Fuel | Wax Content, % | Product | EVA |
| 2 | 3.4 | −17 | −12 |

EXAMPLE 4

A product similar to that of Example C but re-esterified with heptanoic acid (termed Product below) was treated in Fuel 13 and the CFPP compared with that of the same fuel containing the starting copolymer (EVA), in each case at a treat rate of 100 ppm.

| | | CFPP, ° C. | |
|---|---|---|---|
| Fuel | Wax Content, % | Product | EVA |
| 13 | 3.5 | −11 | −4 |

EXAMPLE 5

In this example, the product of Example D, which contains about 5 molar per cent of hexanoate ester units, was used in admixture with the product of Example C, which contains about 15 molar per cent of hexanoate ester units. The Example C product represented 14% of the mixture, that of Example D representing the remainder. The blend is termed "Product" below. The CFPP of various high wax fuels containing an appropriate concentration of the polymer blend was compared with that containing the same concentration of a blend of the starting ethylene-vinyl acetate copolymers in the same relative proportions. The comparison blend is termed EVAs below.

| | Wax | Treat | CFPP, ° C. | |
|---|---|---|---|---|
| Fuel | Content, % | Rate, ppm | Product | EVAs |
| 2 | 3.4 | 300 | −14 | −11 |
| 3 | 3.1 | 100 | −17 | −14 |
| 4 | 3.1 | 200 | −12 | −7 |
| 5 | 2.9 | 200 | −23 | −18 |

What is claimed is:

1. The method of improving the low temperature CFPP flow properties of an oil having a wax content of at least 2.5% by weight, measured at 10° C. below cloud point, comprising adding to the oil an oil soluble ethylene-vinyl ester copolymer having, in addition to units derived from ethylene, vinyl acetate units and units of the formula —$CH_2CROOCR^1$, wherein R represents H or $CH_3$ and $R^1$ represents a hydrocarbyl group having at least 2 carbon atoms, the copolymer having from 1 to 6 methyl groups per 100 methylene units, the improvement in low temperature CFPP flow properties being relative to an identical oil having added thereto ethylene-vinyl acetate copolymers.

2. The method as claimed in claim 1, wherein $R^1$ represents an alkyl group.

3. The method as claimed in claim 2, wherein the alkyl group is linear.

4. The method as claimed in claims 1, 2 or 3 wherein $R^1$ contains from 3 to 9 carbon atoms.

5. The method as claimed in claim 1 wherein $R^1$ represents n-butyl, iso-butyl, or isomers of pentyl, hexyl, heptyl, octyl, nonyl, decyl, undecyl, dodecyl, tridecyl, tetradecyl, pentadecyl, hexadecyl, heptadecyl, octadecyl, nonadecyl or icosyl, or their corresponding alkenyl groups.

6. The method as claimed in claim 1, wherein R represents H.

7. The method as claimed in claim 1 wherein the polymer has a number average molecular weight (Mn) of at most 14,000 and units of the formula —$CH_2CROOR^1$— represent up to 35 mole percent of the polymer.

8. The method as claimed in claim 7, wherein Mn is in the range of from 2,000 to 5,500.

9. The method as claimed in claim 7 wherein units of the formula —$CH_2CROOR^1$— represent from 11 to 16 mole percent of the polymer.

10. The method as claimed in claim 1 wherein the polymer has a number average molecular weight of at most 20,000 and units of the formula —$CH_2CROOR^1$— represent up to 10 mole percent of the polymer.

11. The method as claimed in claim 10, wherein Mn is in the range of from 3,000 to 10,000.

12. The method as claimed in claim 10 wherein units of the formula —$CH_2CROOR^1$— represent from 1.0 to 7.5 mole percent of the polymer.

13. The method as claimed in claim 1, wherein the polymer has been made by saponification and re-esterification of an ethylene-vinyl ester copolymer.

14. The method as claimed in claim 1, wherein the polymer has been made by saponification and re-esterification of an ethylene-vinyl acetate copolymer.

15. The method as claimed in claim 1 wherein the oil is a middle distillate fuel oil.

16. The method as claimed in claim 1 wherein the oil has a wax content of at least 2.9%.

17. An oil having a wax content of at least 2.5% by weight measured at 10° C. below cloud point which exhibits improved low temperature CFPP flow properties and which contains 0.0005 to 1% of a flow improver additive being an oil soluble ethylene-vinyl ester copolymer having in addition to units derived from ethylene, vinyl acetate units and units of the formula —$CH_2CROOCR^1$—, wherein R is H or $CH_3$ and $R^1$ represents a hydrocarbyl group having at least 2 carbon atoms, the copolymer having from 1 to 6 methyl groups per 100 methylene units, the improved low temperature CFPP flow properties being relative to said oil which contains a corresponding amount of ethylene-vinyl acetate copolymer flow improver additive.

18. The composition of claim 17, wherein the oil contains 0.001 to 0.1% by weight of the flow improver additive.

19. The composition of claim 17 or 18 wherein $R^1$ is an alkyl group of 3 to 9 carbon atoms.

20. The composition of claim 17 wherein the copolymer has been made by saponification and re-esterification or transesterification of an ethylene-vinyl acetate copolymer.

21. The composition of claim 17 or 18 wherein the oil has a wax content of at least 3.0%.

22. The composition of claim 17 or 18 wherein the oil has a final boiling point up to 370° C.

* * * * *